United States Patent [19]

Thornton

[11] 4,299,282

[45] Nov. 10, 1981

[54] WELL CLEANER

[76] Inventor: J. W. Thornton, P.O. Box 232, Hartley, Tex. 79044

[21] Appl. No.: 133,919

[22] Filed: Mar. 25, 1980

[51] Int. Cl.[3] ..... B08B 3/02; B08B 9/02; E21B 37/00

[52] U.S. Cl. ..... 166/177; 15/104.09; 166/223

[58] Field of Search ..... 166/170, 171, 173, 177, 166/222, 223; 175/267, 268, 269, 325; 134/166 C, 167 C; 72/39, 40, 208; 15/104.13, 104.14, 104.08, 104.09

[56] References Cited

U.S. PATENT DOCUMENTS

| | | | |
|---|---|---|---|
| 764,684 | 7/1904 | Shaw . | |
| 1,333,390 | 3/1920 | Dickinson . | |
| 1,380,517 | 6/1921 | Bashara . | |
| 1,695,749 | 12/1928 | Watson | 166/223 X |
| 2,174,803 | 10/1939 | Mundt et al. | 15/104.14 X |
| 2,227,763 | 1/1941 | Santiago | 175/269 |
| 2,447,966 | 8/1948 | Stephens . | |
| 2,455,273 | 11/1948 | Schott et al. | 15/104.13 |
| 2,679,383 | 5/1954 | Garrison . | |
| 3,169,580 | 2/1965 | Bateman . | |
| 3,326,294 | 6/1967 | Neilson . | |
| 3,381,754 | 5/1968 | Tompkins . | |
| 4,197,910 | 4/1980 | Hutchison | 166/223 |

*Primary Examiner*—Stephen J. Novosad
*Attorney, Agent, or Firm*—Fleit & Jacobson

[57] ABSTRACT

A device for cleaning rust and mineral deposits from the perforations in the casing of a water well which has rollers which are hydraulically expanded into contact with the inner surface of the casing, the device is then rotated to run the rollers across the clogged perforations. High pressure water jets are provided to flush away the foreign particles which have been dislodged by the rollers. The device is adjustable such that the exact extent of expansion can be set at the surface. A single free-flow hydraulic cylinder actuates the rollers into contact with the inner surface of the casing.

12 Claims, 4 Drawing Figures

WELL CLEANER

BACKGROUND OF THE INVENTION

The present invention relates to an apparatus for cleaning wells and, more specifically, relates to apparatus which is used to remove rust and mineral deposits residing in the perforations of a water well casing.

The ability to obtain large quantities of water is a vital necessity of agriculture, both farming and ranching. It has long been the practice to dig or drill water wells into the earth and to pump the water out of the well. Typically a casing, which has perforations in the bottom area, is placed into the drilled well and after gravel packing the production area of the perforated casing the well is put into production by placing a pump at the bottom of the well. Such wells are vital in the Great Plains area of this country and it is not unusual for a well having a sixteen inch casing to produce from 400 to 1800 gallons per minute, although a well producing 1000 gallons per minute is generally considered a good well.

The static water level in the northern Panhandle area is approximately 400 feet from the surface or ground level. When the casing perforations become clogged the water level inside the casing will drop to a static level of approximately 550 feet or whatever level the pump is set at. If the well does not make enough water, the pump will start to pump air. Often it can ruin a pump and waste gas. When the pump starts sucking air, it is called surging or pumping off. When the water level drops the only alternative to obtain water is to drill another well. At current prices, by using the inventive device, the well can be cleaned out for about 20% of the cost of drilling a new well. After cleaning, the amount of water flow will increase and the amount of gas used will decrease by about one-third ($\frac{1}{3}$), due to the fact that the water level will rise by approximately 150 feet in the well casing. This energy reduction will save the farmer substantial costs, and ease the current energy crisis.

The type of casing employed in these wells is perforated typically by means of a cutting torch, and the perforations comprise eight to twelve-inch long vertical slots spaced approximately four inches apart on the circumference of the casing. Forming the perforations in this manner usually results in the formation of burrs along the perforations on the inside of the casing. The perforations in the casing are then repeated at vertical intervals approximately equal to the length of the perforation, i.e., eight to twelve-inches above and below a ring of perforations will be another ring of perforations.

At the beginning of production of a well, the perforations perform entirely as desired; however, as the well becomes older and the well is in production for a while, the perforations tend to become plugged and clogged with mineral particles in the water and with rust formed at the edges of the perforations of the pipe. Principally, the plugging of the casing perforations in a water well is directly related to rust. There have been many previous attempts at efficiently cleaning the perforations of this rust. One approach is to employ a rotating wire brush or the like, which is run down inside the casing and then rotated relative to the casing. The bristles of the brush are intended to knock loose the rust particles. Another approach has been to utilize streams of extremely high-pressure water in the casing; for example, water pressures up to 12,000 psi have been employed. However, in the vast majority of cases, all of these efforts to clean the casing perforations to improve the water production, have been unsuccessful or inefficient.

SUMMARY OF THE INVENTION

The present invention provides a rotating well cleaner which is expanded inside the casing, to bring hardened rollers into contact with the plugged perforations. Upon expansion and rotation of the inventive well cleaner, the rollers will contact the perforations and loosen the rust. Water jets are also provided in the inventive well cleaner, which aid in flushing the perforations during the cleaning operation.

The present invention provides a cylindrically shaped well cleaner, which is adjustable at the surface to the inside diameter of the casing to be cleaned. The inventive well cleaner is then run into the casing to be adjacent the plugged perforations. Upon application of hydraulic pressure, the well cleaner expands to the desired diameter set on the surface, so as to place a plurality of rollers into contact with the inside surface of the casing and into contact with the plugged perforations. The inventive well-cleaning tool is then rotated from the surface and the rotation will cause the rollers to run over the burrs near the perforations. The rollers running over the perforations will set up extreme vibrations, as well as applying outwardly radial forces to the casing at the location of the perforations. These outwardly radial forces tend to deform the casing, by slightly increasing the inside diameter of the casing and, thereby, the plugging rust particles are dislodged. Water jets are located in the vicinity of the rollers, and high-pressure water is squirted therefrom at approximately 550 psi, which serves to flush the dislodged particles from the perforations.

Therefore, it is an object of the present invention to provide a well-cleaning device which may be used to clean the perforations in the casing of a water well.

It is another object of the present invention to provide a well-cleaning device which is presettable at the surface to an exact setting based upon the diameter of the pipe to be cleaned.

It is a further object of the present invention to provide a well-cleaning device, which is expanded after being run into the well at the location of the perforations so as to bring specialized rollers into contact with the perforations, so as to dislodge the foreign blocking material.

It is still a further object of the present invention to provide a rotating well-cleaning device which, while contacting the plugged perforations, will provide a high-pressure jet of water which serves to flush the foreign matter from the perforations.

The manner in which these and other objects are accomplished by the present invention will be made clear from the following detailed description of the preferred embodiment.

DETAILED DESCRIPTION OF THE PREFERRED EMBODIMENT

Figure 1:
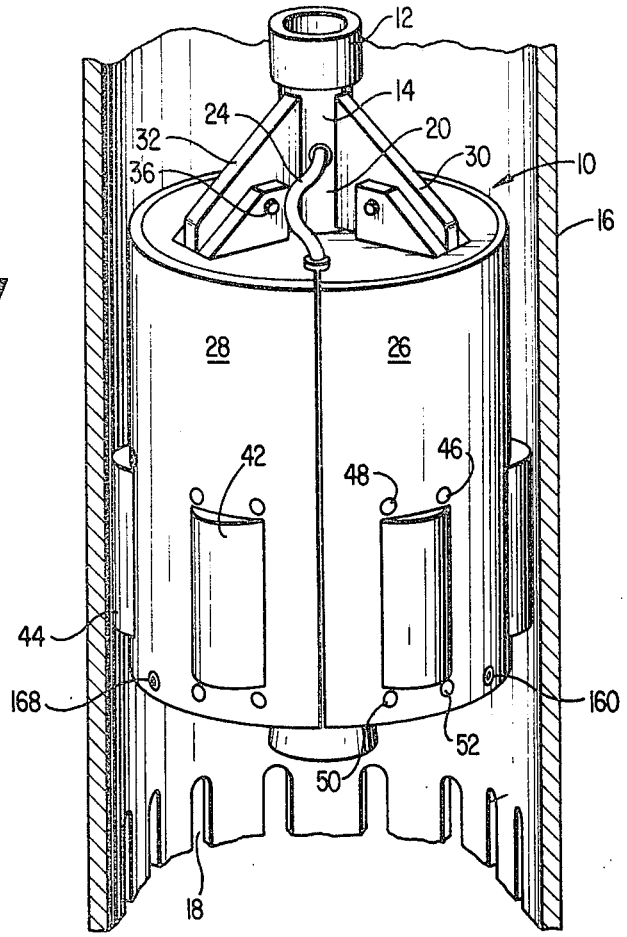
FIG. 1 is a perspective of the inventive well cleaner located inside the casing of a typical water well.

Referring now to FIG. 1, the inventive well cleaner, shown typically at 10, has been threadedly connected to a length of standard drill pipe 12. The interface portion of the inventive well cleaner is an API pin down 14, which provides a standard ASP tool joint, for connection to the standard drill pipe 12. The well cleaner 10 is shown located inside a conventional well casing 16, which may be anywhere from sixteen to eighteen inches in inside diameter. The well is produced through this casing and, specifically through the perforations, shown typically at 18. These perforations 18 are generally formed in the casing 16 by means of a conventional cutting torch. The perforations are then approximately $\frac{1}{8}$ inch wide slots which are eight to twelve inches in length, and which are generally spaced four inches apart around the circumference of the casing 16. As may be appreciated, when these perforations 18 are cut into the casing 16, there are burrs and the like formed on the inside surface of the pipe, because the cutting torch is operated from the outside of the casing. As seen in FIG. 1, the well cleaner 10 is not yet in position to perform the perforation cleaning operation, since it is slightly above the location of the perforations 18 in the casing 16.

The inventive well-cleaning device 10 is caused to be expanded into contact with the inside of the casing by means of hydraulic pressure. It is intended that water pressure be delivered through the drill pipe 12 into the API pin down adapter 14. The adapter 14 is welded to a short length of drill pipe 20, to which other frame members are attached. The water is then fed through high-pressure hydraulic tubing 24 into the hydraulic actuating cylinder of the well cleaner 10. The well cleaner 10 is divided into three segments, two of which are seen at 26 and 28. It is understood, of course, that the third segment is hidden from view at the rear of the device 10. Each of these segments, 26 and 28, is pivotally suspended from a main triangular brace 30 and 32, respectively. This pivotal mounting is accomplished by means of nut and bolt assemblies, 34 and 36, respectively.

During operation of the inventive cleaner, the segments 26 and 28, as well as the segment hidden from view in FIG. 1, are expanded outwardly and the rollers mounted in each segment come into contact with the inside diameter of the well casing 16. The rollers relative to segment 26 are shown at 38 and 40, and the rollers relative to segment 28 are shown at 42 and 44. The rollers are mounted in suitable mounting blocks inside the segment. The rollers are held by a fixed shaft (not shown), and turn on Timken cone bearings mounted on the shaft. The shafts are mounted to the mounting blocks. The fasteners for the mounting blocks are shown in relation to segment 26 at 46, 48, 50 and 52. All of the rollers in the well cleaner 10 are mounted in the same manner and, hence, the fasteners relative to the other rollers are also seen in FIG. 1.

Figure 2:
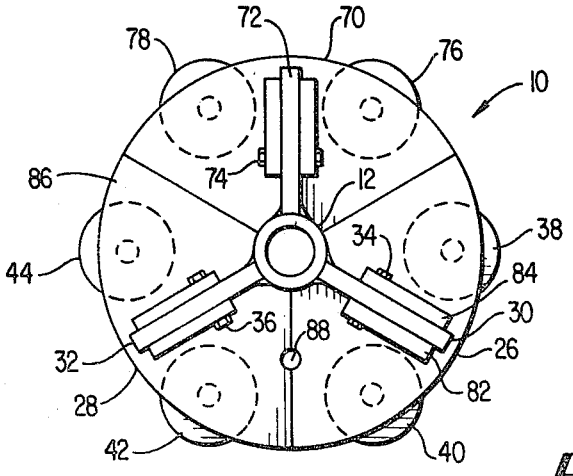
FIG. 2 is a top plan view of the inventive well cleaner.

Referring now to FIG. 2, the well cleaner is seen in a top view, wherein all three segments 26, 28 and 70 are shown suspended from three triangularly shaped members 30, 32 and 72, respectively. Segment 70 has associated with it two rollers, 76 and 78, mounted in the same way as the rollers in the other segments. In FIG. 2, the hydraulic line 24 is not shown, so that the manner in which this hydraulic line enters into the well cleaner 10, may be shown. All of the segments are identical and segment 26 will be described, as being typical of these segments. Segment 26 is formed of a top plate 80 of $1\frac{1}{2}$ inch steel plate and attached to it are two upraised members 82, 84 arranged on either side of the triangular brace 30. The nut and bolt assembly 34 passes through the triangular member 30 and the two upraised portions, 82 and 84, arranged on either side of the triangular member, to pivotally suspend section 26. Segments 28 and 70 are also suspended from their respective triangular brace in the same manner. At the line where top plate 80 of segment 26 joins the top plate 86 of segment 28 there is a clearance hole 88, which is formed by milling a semicircle in the edge portion of plate 80 and milling a similar semicircle in the edge portion of plate 86 exactly opposite the semicircle in plate 80. It is this clearance hole 88 which permits the hydraulic line 24 of FIG. 1 to enter the interior of the well cleaner 10.

Figure 3:
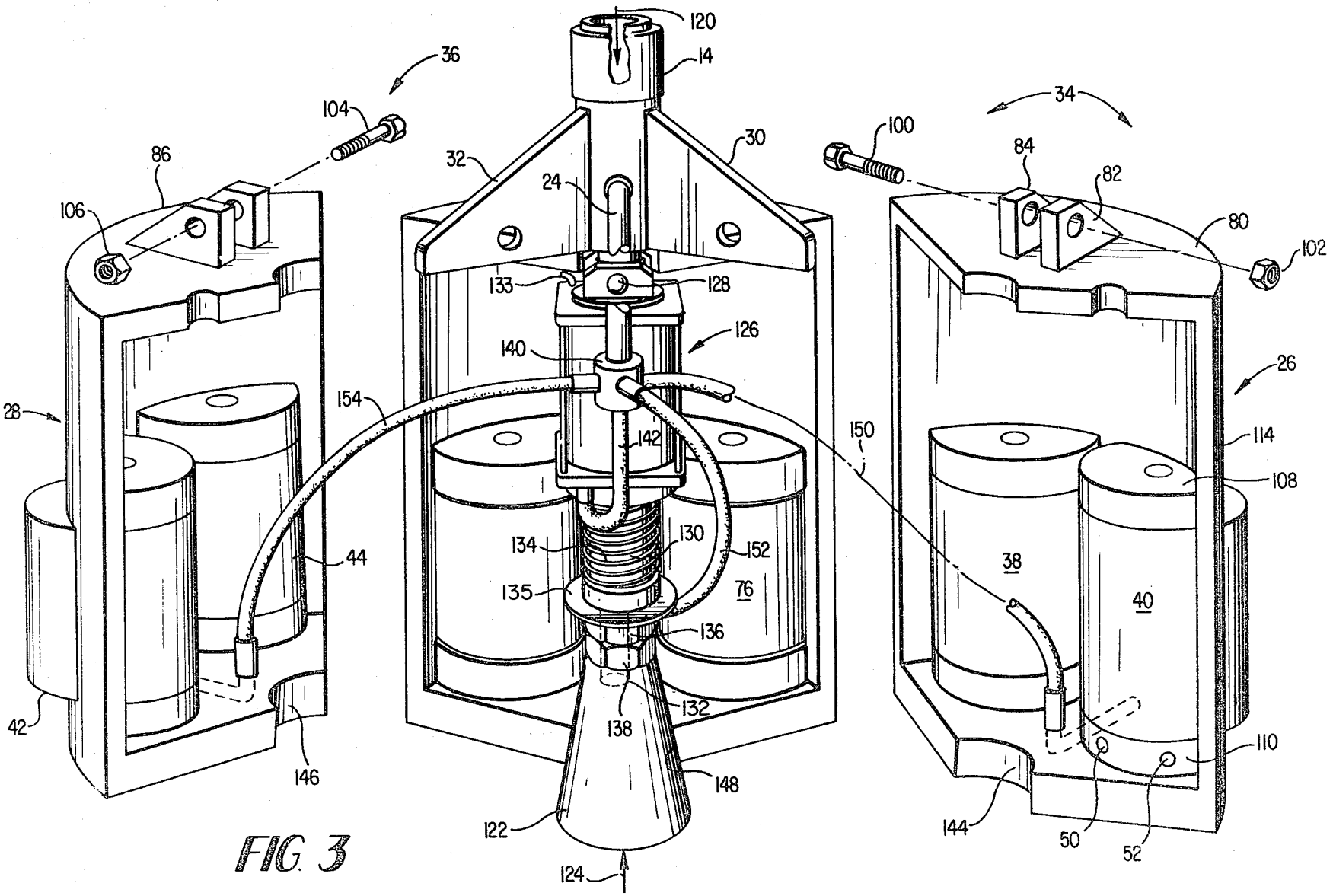
FIG. 3 is a perspective of the inventive well cleaner in a partially disassembled state, so as to provide a view of the interior thereof.

FIG. 3 is an exploded perspective view of the well cleaner 10 and, in this view, segment 26 is disassembled and moved away from the well cleaner 10. Segment 28 is also similarly disassembled. Segments, 26 and 28, are disassembled by removing the nut and bolt assemblies, 34 and 36. Assembly 34 is formed of a bolt 100 and nut 102, and assembly 36 is formed of a bolt 104 and nut 106. These assemblies are removed by unthreading the nut and bolt assemblies and pulling the bolt out, which is the only machine element mechanically holding the segments to the top frame, formed of the adapter 14, the tube 20 and the triangular members, 30, 32 and 72.

As may be seen in FIG. 3, each segment, e.g., segment 26, has the rollers rotatably mounted therein in suitable bearing blocks shown relative to roller 40 at 108 and 110. All of the rollers are mounted in their respective segments in substantially the same manner, and it is these bearing blocks 108 and 110 which are fastened to the segment 26 by means of the fasteners 46, 48, 50 and 52. All of the rollers are mounted in substantially the same fashion.

Each of the three segments 26, 28 and 70 is formed substantially in the same manner. With respect to segment 26, it has a top plate 80 which is formed of $1\frac{1}{2}$ inch steel plate, and it has a similar $1\frac{1}{2}$ inch bottom plate 112. Since the inventive cleaner has three segments 26, 28 and 70, each of these segments and, hence, each of the top and bottom plates describes an arc of approximately 120°. The walls of segment 26 are formed of a length of $\frac{3}{4}$-inch thick pipe 114 which also describes an arc of 120°. Each of the other segments, 28 and 70, is also formed in the same manner as segment 26, i.e., with a length of pipe and top and bottom plates.

As indicated above, in the operation of the inventive cleaner, the segments 26, 28 and 70 are pivotally suspended from their respective triangular elements and are driven radially outward, once the tool is in the proper location inside the well casing, in order to cause the rollers to abut the inside surface of the casing. This operation is accomplished by means of water pressure, which is fed down through the drill string as indicated by arrow 120. Water pressure up to 550 psi is intended to be applied to the inventive device. The segments are pivotally suspended and are driven in a radially outward manner by the linear action of a conical wedging element 122, which is driven in an up and down fashion as indicated by arrow 124. The conical wedge 122 is driven by means of a one-way hydraulic cylinder 126. This one-way hydraulic cylinder 126 is a free-flow cylinder and can handle up to 2800 psi. The cylinder is affixed to the lower portion of tube 20 by means of a nut and bolt assembly 128. The movable shaft or rod 130 of cylinder 126, which, as is well-known, would have a piston (not shown) associated therewith, is provided with a threaded end portion, which is approximately three inches in length. This threaded portion is shown at 132. Since the cylinder 126 is a one-way cylinder shaft 130, and its associated piston (not shown), an open fluid outlet 133 is provided, and the cylinder is caused to return to its at rest position by means of a large compression spring 134, which is arranged around the output shaft 130. The forces of spring 134 are imparted to the conical wedge 122 by means of a washer 135. Therefore, in the assembly of the inventive cylinder 126, the spring 134 is placed over the shaft 130 and the washer 135 is installed, then a first nut 136 is threaded onto the threaded end 132 of the shaft 130, then a second nut 138 is threaded onto the shaft 130 and, finally, the conical wedge 122 is threaded onto the shaft 130.

A feature of the inventive well cleaner 10 is that it is adaptable for use with casings having varying inside diameters. (Typically, the outside diameter of the casing is 16 inches, but the inside diameter can vary depending on the wall thickness of the casing.) In other words, the exact amount of expansion of the well cleaner can be accurately controlled, so that only the desired amount of force is exerted by the rollers on the inside surface of the casing. The extent of travel of the pivotable segments and, hence, the amount of force applied during the cleaning operation is controlled by adjusting the location of the conical wedge member 122 on the cylinder shaft 130. The position of the conical wedge 122 on the output shaft 130 is controlled by means of the threaded end 132, which permits the conical wedge 122 to be run up to a predetermined location. After the conical wedge 122 is in position on the threaded portion 132, it is then locked in place on the shaft by means of the second nut 138. This nut is in turn locked in its position by means of nut 136, which performs the function of a jam nut. Thus, the exact location of the conical wedge 122 can be easily and accurately controlled.

The hydraulic cylinder 126 is activated by hydraulic pressure supplied, as indicated by the arrow 120, into the adapter 14, which is then fed out of the main tube 20 on line 24, into a tee 140, and from tee 140 via hydraulic line 142 into the inlet of cylinder 126. Upon application of the pressure, the hydraulic cylinder 126 is activated and the conical wedge 122 is driven in the direction indicated by arrow 124, this causes the segments 26, 28 and 70 to be driven outwardly by interaction between conical wedge 122 and semicircular relieved camming surfaces 144, 146 and 148, in the bottom plate of each segment 26, 28 and 70, respectively. The semicircularly relieved camming surfaces 144, 146, 148 are formed having the same conical taper as the cone angle of conical wedge 122.

Concurrent with the rotational action of the well cleaner, high-pressure jets are also applied to clean the well-casing perforations. These water jets are obtained from the same water pressure which actuates the hydraulic cylinder 126. Accordingly, the water pressure for the jets is obtained from tee 140 and is fed to each of the three segments on lines 150, 152 and 154. The jet output is located on the outward circumference of the lower portion of the segments and is arranged between the rollers. The water is fed to the jet output by drilling a hole in the bottom plate of the segment, for example, in plate 112 of segment 26, and threadedly engaging the appropriate hydraulic pressure line 150, 152 or 154 to the hole in the segment bottom plate. The water jet output may be seen in FIG. 1 at 160 relative to segment 26 and at 162 relative to segment 28. Thus, the water path makes a ninety degree turn from the top of the plate 112 to the jet output 160. A specialized jet nozzle is threaded into the outlet of the water jet or the hole drilled into the wall 114 of the segment 26 may serve as the jet nozzle for that segment.

The operation of the inventive well cleaner will now be described in relation to FIG. 4. As indicated above, the inventive well cleaner can be used to clean well casings having varying inside diameters. A portion of the well casing having a micrometer assembly attached thereto may be used as a calibration tool for use on the surface to determine accurately the extent of travel of the pivotal segments of the inventive tool. This travel will dictate the forces applied to the inside wall of the casing and the amount of deformation of the casing, if any. This adjustment as indicated above, is achieved by varying the position of the conical wedge 122 on the actuating shaft of the hydraulic cylinder. In this manner, the exact extent of expansion of the well-cleaning device may be determined on the surface. Thus, the tool may be calibrated on the surface for use with different inner diameter well casings.

Assuming that the inventive well-cleaning device has been suitably calibrated on the surface to the appropriate diameter for the casing to be cleaned, it is then lowered into the well casing in the conventional manner by means of successive lengths of drill pipe. The well-cleaning device 10 is positioned down in the well at the location of the perforations 18. At this point, the hydraulic pressure is applied into the drill pipe at approximately 550 psi and the hydraulic cylinder 126 is actuated, thereby expanding the pivotal segments 26, 28 and 70 to the extent set at the surface. Simultaneously therewith, the high-pressure water will be caused to exit from the three jets. Upon applying the high-pressure water, the inventive well-cleaning device 10 is rotated by turning the drill string at the surface in the conventional manner. Generally, the drill pipe has a right-handed thread; thus, the pipe must be rotated in a clockwise direction to prevent the pipe from unscrewing at the joint. However, if the drill pipe had a left-handed thread, rotation could be in a counterclockwise direction. It should be appreciated that the rotation of the well-cleaning device 10 can be designed to be used in either direction with equally good results. The speed of rotation may be from 250 revolutions per minute up to 1000 revolutions per minute.

Figure 4:
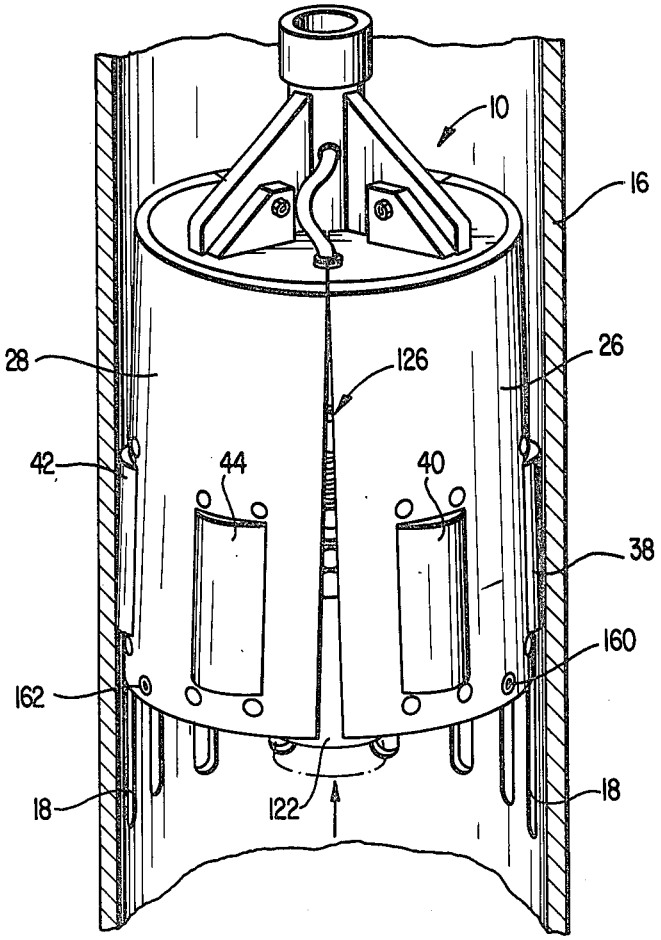
FIG. 4 is a perspective of the inventive well cleaner in its operative state inside a typical water-well casing.

When the water pressure is applied, the rollers, for example, rollers 38 and 42 in the sectional view of FIG. 4, are caused to come into contact with the inner surface of the casing. Since the segments 26, 28 and 70 are pivoted from the top, and they are driven radially outward, the entire length of the roller will not contact the inside of the pipe. For example, with a six-inch roller, only about four inches of the length of the roller will abut the inside diameter of the casing. The rollers are preferably fabricated of case-hardened steel, but they may be further hardened by running a bead of hard facing on their surface. The rollers may be hardened to a Brinnel hardness of approximately 28,000.

When rotating the well-cleaning device 10, the rollers come into contact, and pass over, each of the perforations or slots 18 in the casing. As indicated above, the slots are typically formed by a cutting torch applied from the outside of the casing, and the slots formed on the inside of the casing have burrs or ridges in the vicinity of the slots. The rollers will contact these burrs on the inside of the casing and will set up extreme vibrations, which tend to jar or vibrate loose the rust particles and mineral deposits residing in the perforations. These rust particles are then flushed away by the water jets from the well cleaner.

Because the well cleaner employs water pressure of 550 psi, it will exert a tremendous force on the inside surface of the well casing tending to expand it to a larger diameter. Such expansion will also aid in dislodging the rust particles and mineral deposits. By rotating the tool inside the casing and expanding the casing slightly, the rust particles are broken loose and flushed away by the three water jets. The present invention is constructed in such a manner that the diameter of the casing may be deformed by a substantial amount if necessary and, theoretically, the present invention is constructed so that it is capable of bursting the walls of the pipe; however, this is not a desirable situation. Most well casings, when expanded only a 1/32 of an inch in diameter, have enough elasticity to return to their original diameter. Expansion of 1/32 of an inch almost ensures that the rust particles will be dislodged.

When the hydraulic pressure is removed, there will be no forces exerted to keep shaft 130 pulled in, since cylinder 126 is a one-way cylinder. Therefore, spring 134 will force shaft 130 to its extended position where conical wedge 122 exerts no camming action on the three segments 26, 28 and 70. Since these three segments are pivotally mounted, and they are made of heavy gauge steel, gravity will cause them to fall down into the relaxed or nonoperative state.

It is understood, of course, that the foregoing description is presented by way of example only and is not intended to limit the scope of the present invention, except as set forth in the appended claims.

What is claimed is:

1. An apparatus connected to a hydraulic pressure source and a rotary drive means for cleaning perforations in a well casing, comprising:

body means in the form of a cylinder having its longitudinal axis coaxial with the casing and formed of at least two arcuately-shaped portions pivotally attached at an upper end thereof to an upper frame member of said body means, a plurality of rollers, at least one of which is rotatably mounted on the exterior of each of said arcuately-shaped portions; and actuation means arranged inside said body means comprising a hydraulic cylinder operably connectable to the hydraulic pressure source for moving said rollers into contact with the inner surface of the casing, wherein said hydraulic cylinder has an output shaft having a tapered element threadedly affixed to the end thereof, said tapered element cooperating with a camming surface on each of said at least two arcuately-shaped portions, said camming surfaces being located on said arcuately-shaped portions at the ends thereof opposite the pivotable attachment of said upper frame member. cooperating with said output shaft of said hydraulic cylinder to move said rollers radially outwardly into contact with the inside of the casing upon linear movement of said output shaft.

2. The apparatus of claim 1, further comprising at least one water jet formed in said body means, having an inlet connected to the hydraulic pressure source and an outlet located on the exterior of said body means and being directed radially away therefrom for directing a jet toward the perforations.

3. The apparatus of claim 1, further comprising interface means mounted on said body means for connection to the hydraulic pressure source and hydraulic conduit means connecting the interface means with the actuation means.

4. An apparatus connected to a hydraulic pressure source and a rotary drive means for cleaning perforations in a well casing, comprising:

body means comprising three arcuately-shaped portions forming a cylinder having its longitudinal axis coaxial with the casing, said arcuately-shaped portions pivotally attached at an upper end thereof to an upper frame member of said body means, each of said portions having two cylindrical rollers rotatably mounted thereon and arranged having its longitudinal axis substantially aligned with the longitudinal axis of the casing; and actuation means arranged inside said body means and connected to the hydraulic pressure source for moving said pivotally attached arcuately-shaped portions such that the rollers move radially outwardly into contact with the inner surface of the casing.

5. An apparatus connected to a hydraulic pressure source and a rotary drive means for cleaning perforations in a well casing, comprising:

body means having a plurality of rollers movably mounted on the exterior thereof;

actuation means arranged inside said body means and connected to the hydraulic pressure source for moving said rollers into contact with the inner surface of the casing, and interface means comprising an API pin down for connection to a standard drill pipe, said interface means mounted on said body means for connection to the hydraulic pressure source through said drill pipe, and hydraulic conduit means connecting the interface means with the actuation means.

6. A rotatable device for connection to a hydraulic pressure source for cleaning foreign materials from perforations in a metal casing of a well, said device comprising:

a segmented cylindrical body formed from at least two curved outer wall portions, said cylindrical body having interface means affixed to an end thereof for connection to the hydraulic pressure source and having at least two cylindrical rotatable rollers mounted on said curved outer wall portions of said cylindrical body for movement radially outwardly relative to said interface means; and a hydraulic cylinder means arranged interior to said body having a hydraulic pressure inlet connected to said interface means for receiving the hydraulic pressure and an output shaft cooperating with said body for moving said rollers radially outwardly; wherein each curved outer wall portion is pivotally mounted to an upper frame member of said interface means, said two curved outer wall portions cooperating with said output shaft of said hydraulic cylinder to move said rollers radially outwardly into contact with the inside of the casing upon linear movement of said output shaft.

7. The apparatus of claim 6, further comprising a conical wedging element affixed to the end of said output shaft of said hydraulic cylinder and being arranged having the apex of said conical wedging element pointing towards said upper frame member, the exterior surface of said conical wedging element cooperating with camming surfaces arranged on said two curved outer wall portions, for moving said curved outer wall portions radially outwardly upon movement of said shaft towards said upper frame member.

8. The apparatus of claim 7, wherein the end of said output shaft of said hydraulic cylinder is threaded and the conical wedging element is threadedly connected to said output shaft and further including means for locking said conical wedging element at any preselected point on the threaded portion of said output shaft.

9. The apparatus of claim 6, further comprising water jets located in said curved outer wall portions and being aimed outwardly toward the perforations, said water jets being connected to the hydraulic pressure source via said interface means.

10. The apparatus of claim 6, wherein six rollers are provided with two rollers being mounted on each of three individual curved outer wall portions, each of said three curved outer wall portions having a camming surface arranged thereon for cooperation with said hydraulic cylinder means for moving said three curved outer wall portions radially outwardly.

11. A rotatable device for connection to a hydraulic pressure source for cleaning foreign materials from perforations in a metal casing of a well, said device comprising:

a segmented cylindrical body having interface means affixed to an end thereof for connection to the hydraulic pressure source and having at least two cylindrical rotatable rollers mounted on said cylindrical body for movement radially outwardly relative to said interface means; and a hydraulic cylinder means arranged interior to said body having a hydraulic pressure inlet connected to said interface means for receiving the hydraulic pressure and an output shaft cooperating with said body for moving said rollers radially outwardly; wherein said interface means comprises an API pin down for connection to a standard drill pipe, whereby the hydraulic pressure source is connected on the surface to feed through the drill pipe.

12. A rotatable device for connection to a hydraulic pressure source for cleaning foreign materials from perforations in a metal casing of a well, said device comprising:

a segmented cylindrical body having interface means affixed to an end thereof for connection to the hydraulic pressure source and having at least two cylindrical rotatable rollers mounted on said cylindrical body for movement radially outwardly relative to said interface means; and a hydraulic cylinder means arranged interior to said body having a hydraulic pressure inlet connected to said interface means for receiving the hydraulic pressure and an output shaft cooperating with said body for moving said rollers radially outwardly; wherein said hydraulic cylinder means is a one-way cylinder having an open hydraulic outlet and further comprising a compression spring arranged around said output shaft for causing said shaft to be in an extended position when no hydraulic pressure is applied to said cylinder, said hydraulic cylinder operating to retract said shaft when said hydraulic pressure is applied to said hydraulic cylinder.

* * * * *